US005558686A

United States Patent [19]

Lavelle, IV

[11] Patent Number: 5,558,686

[45] Date of Patent: Sep. 24, 1996

[54] METHOD FOR MAKING A FUEL PRODUCT

[75] Inventor: William A. Lavelle, IV, Gouldsboro, Pa.

[73] Assignee: Alpha-Omega Energia, Inc., Gouldsboro, Pa.

[21] Appl. No.: 138,943

[22] Filed: Oct. 19, 1993

[51] Int. Cl.[6] ..... C10L 1/00

[52] U.S. Cl. ..... 44/606; 44/589; 44/605

[58] Field of Search ..... 44/605, 606, 589

[56] References Cited

U.S. PATENT DOCUMENTS

| | | | |
|---|---|---|---|
| Re. 29,156 | 3/1977 | Marsh | 44/605 |
| Re. 29,312 | 7/1977 | Mallan et al. | 48/209 |
| 1,064,773 | 6/1913 | Richter | 44/505 |
| 1,633,078 | 6/1927 | Engle | 44/605 |
| 3,596,614 | 8/1971 | Smith et al. | 110/8 P |
| 3,647,405 | 3/1972 | Smith | 65/19 |
| 3,830,636 | 8/1974 | Marsh | 44/1 D |
| 3,861,333 | 1/1975 | Krumm | 110/8 R |
| 3,910,775 | 10/1975 | Jackman | 44/13 |
| 3,921,543 | 11/1975 | Menigat et al. | 110/7 B |
| 3,960,537 | 6/1976 | Kaelin | 71/9 |
| 4,008,053 | 2/1977 | Brenneman et al. | 44/1 D |
| 4,026,678 | 5/1977 | Livingston | 44/1 D |
| 4,033,763 | 7/1977 | Markels, Jr. | 75/97 R |
| 4,049,391 | 9/1977 | Marsh | 44/10 R |
| 4,056,465 | 11/1977 | Spector et al. | 210/7 |
| 4,063,903 | 12/1977 | Beningson et al. | 44/2 |
| 4,152,119 | 5/1979 | Schulz | 44/1 D |
| 4,153,514 | 5/1979 | Garrett | 201/2.5 |
| 4,159,684 | 7/1979 | Kirkup | 110/346 |
| 4,180,004 | 12/1979 | Johnson | 110/346 |
| 4,203,376 | 5/1980 | Hood | 110/346 |
| 4,245,999 | 1/1981 | Reiniger | 44/1 D |
| 4,303,412 | 12/1981 | Baikoff | 44/1 D |
| 4,324,561 | 4/1982 | Dean et al. | 44/10 E |
| 4,392,881 | 7/1983 | Kneer | 71/9 |
| 4,395,265 | 7/1983 | Reilly et al. | 44/15 R |
| 4,405,331 | 9/1983 | Blaustein et al. | 44/1 D |
| 4,448,589 | 5/1984 | Fan | 48/197 |
| 4,454,427 | 6/1984 | Sosnowski et al. | 290/2 |
| 4,496,365 | 1/1985 | Lindemann | 44/1 D |
| 4,506,631 | 3/1985 | Phong-Anant | 122/2 |
| 4,552,666 | 11/1985 | Müller | 210/710 |
| 4,615,711 | 10/1986 | Müller et al. | 44/589 |
| 4,659,472 | 4/1987 | Nordlund et al. | 210/609 |
| 4,762,527 | 8/1988 | Beshore et al. | 44/51 |
| 4,775,388 | 10/1988 | Beshore | 44/51 |

(List continued on next page.)

OTHER PUBLICATIONS

C. R. McCoy, "Sludge Plant's Success Story," *The Philadelphia Inquirer,* Section B, pp. B1, B4 (Apr. 9, 1995).

G. B. Wilson et al., *Manual for Composting Sewage Sludge by the Beltsville Aerated–Pile Method,* Office of Research and Development, Washington, DC, EPA–600/8–80–022, May (1980).

A. H. Benedict et al., *Composting Municipal Sludge: A Technology Evaluation,* Noyes Data Corporation, Park Ridge, NJ (1987); month N/A.

T. B. S. Prakasam et al., "Effects of Sewage and Sludge Treatment on Sludge and Compost Characteristics," *Design of Municipal Sludge Compost Facilities,* Hazardous Materials Control Research Institute, pp. 14–22 (Aug. 1978).

R. Horvath, "Operating and Design Criteria for Windrow Composting of Sludge," *Design of Municipal Sludge Compost Facilities,* Hazardous Materials Control Research Institute, pp. 88–95 (1978); month N/A.

M. Alexander, *Introduction to Soil Microbiology,* 2nd Ed., John Wiley and Sons, New York, NY, p. 355 (1977) month N/A.

*Primary Examiner*—Ellen M. McAvoy

*Attorney, Agent, or Firm*—Panitch Schwarze Jacobs & Nadel, P.C.

[57] ABSTRACT

Methods for producing a combustible fuel product from a biological sludge are provided. A removable bulking agent is mixed with the sludge and the mixture aerobically composted under conditions effective to substantially reduce the level of pathogenic microorganisms and provide a fuel product with a heating value of about 3,800 Btu/lb after removal of the bulking agent.

15 Claims, 1 Drawing Sheet

U.S. PATENT DOCUMENTS

| | | | |
|---|---|---|---|
| 4,818,505 | 4/1989 | Müller | 44/589 |
| 4,823,712 | 4/1989 | Wormer | 110/245 |
| 4,828,577 | 5/1989 | Markham, Jr. et al. | 44/589 |
| 4,834,003 | 5/1989 | Reischl | 110/346 |
| 4,859,211 | 8/1989 | Moore | 44/589 |
| 4,894,066 | 1/1990 | Castelli | 44/589 |
| 4,934,285 | 6/1990 | Jormanainen | 110/346 |
| 4,957,049 | 9/1990 | Strohmeyer, Jr. | 110/234 |
| 4,983,296 | 1/1991 | McMahon | 210/603 |
| 5,019,267 | 5/1991 | Eberhard et al. | 210/606 |
| 5,114,541 | 5/1992 | Bayer | 201/2.5 |
| 5,125,931 | 6/1992 | Schulz | 44/552 |
| 5,130,092 | 7/1992 | Liu | 422/28 |
| 5,141,526 | 8/1992 | Chu | 44/576 |

METHOD FOR MAKING A FUEL PRODUCT

FIELD OF THE INVENTION

This invention relates to a method for making a fuel product from biological sludge and the product produced thereby.

BACKGROUND OF THE INVENTION

Biological sludge disposal is a growing worldwide problem. In the United States, sewage sludge production is in excess of 20,000 tons/day and disposal costs have increased sharply due to bans on ocean dumping and decreasing landfill capacity.

The unlimited resource of sewage sludge can be processed for use as a soil conditioner or fertilizer. In the United States, Environmental Protection Agency (EPA) regulations must be met with regard to remaining pathogen levels before processed sludge can be used in this manner and only a small fraction of the generated sludge is converted to this end product.

Composting has also been used as a disposal method for sewage sludge. Methods for producing a compostable mixture of sewage sludge and composting are disclosed in U.S. Pat. No. 4,659,472. A material such as sawdust is mixed with wet sewage sludge in the presence of air. The mixture is supplied with a polyelectrolyte solution and then pressed to a solids content of about 30 percent by weight. The resultant compostable mixture can be subjected to a composting process in containers having a 15–20 $m^3$ volume. The containers have a device for supplying and distributing air through the mass of compostable material present in the container. Temperatures of 50° C. (122° F.) are obtained after 24 hours and temperatures of 50° to 60° C. (122° to 140° F.) for a period of seven days are used to destroy pathogenic microorganisms.

U.S. Pat. No. 4,392,881 discloses a process for composting sewage sludge using two processing steps. Waste material is introduced into a first closed vessel and continuously aerated from the bottom. The material in the vessel is discharged from the bottom such that it is resident within the vessel for 7 to 14 days. Material discharged from the first vessel, now biologically active, is transferred to a second closed vessel and aerated discontinuously. The material is resident in the second vessel for 14 to 20 days. The final product is disclosed to be useful as fodder.

Sludge has also been disposed of by combustion. A rapid expansion of this technology began in the late 1950s and continued through the late 1970s.

Processing of sewage sludge for use as a fuel has been disclosed in U.S. Pat. No. 1,064,773 which discloses a process of dewatering and using raw sewage by mixing it with finely divided active carbon and then aerating the mixture with an oxygen containing gas. The aerated material is then dewatered. The material can be pressed into cakes and used as a fuel.

U.S. Pat. No. 4,552,666 discloses adding dried autumn foliage or extracts thereof to digested sewage sludge to sediment the sludge into deformable materials which can be shaped into briquettes for use as a fuel.

U.S. Pat. No. 4,828,577 discloses a method for burning food preparation wastewater sludges. The fuel value can be increased by adding a bulking agent such as sawdust.

At its height, approximately 5,060 tons/day out of 18,750 tons/day solids produced by U.S. wastewater treatment plants were being combusted. However, the technology has fallen into disuse due to high costs associated with sludge processing to achieve a moisture content which results in a heating value competitive with other waste fuels such as anthracite culm. Accordingly, a need exist for a facile, efficient and inexpensive method to produce a low sulfur or sulfur free combustible fuel product from biological sludge with a heating value competitive with currently used waste fuels.

SUMMARY OF THE INVENTION

Briefly stated, the present invention relates to a method for producing a combustible fuel product from biological sludge. A removable bulking agent is mixed with the sludge and the mixture composted aerobically under conditions effective to attain a temperature of about 170° F. to about 175° F. The temperature range of the mixture is maintained for a time period sufficient to substantially reduce pathogenic microorganisms and produce a composted sludge mixture having a moisture content of up to about 45 percent. The bulking agent is then separated from the composted sludge. The separated composted sludge has a moisture content of up to about 45 percent, a heating value of about 3,800 Btu/lb and is sulfur free.

The present invention also relates to the combustible fuel product produced by the method described above.

BRIEF DESCRIPTION OF THE DRAWING

The foregoing summary, as well as the detailed description of the preferred embodiments, will be better understood when read in conjunction with the appended drawing. For the purpose of illustrating the invention, there is shown in the drawing an embodiments which is presently preferred; it being understood, however, that this invention is not limited to the precise arrangements and instrumentalities shown. In the drawings.

DETAILED DESCRIPTION OF THE PREFERRED EMBODIMENTS

Figure 1:
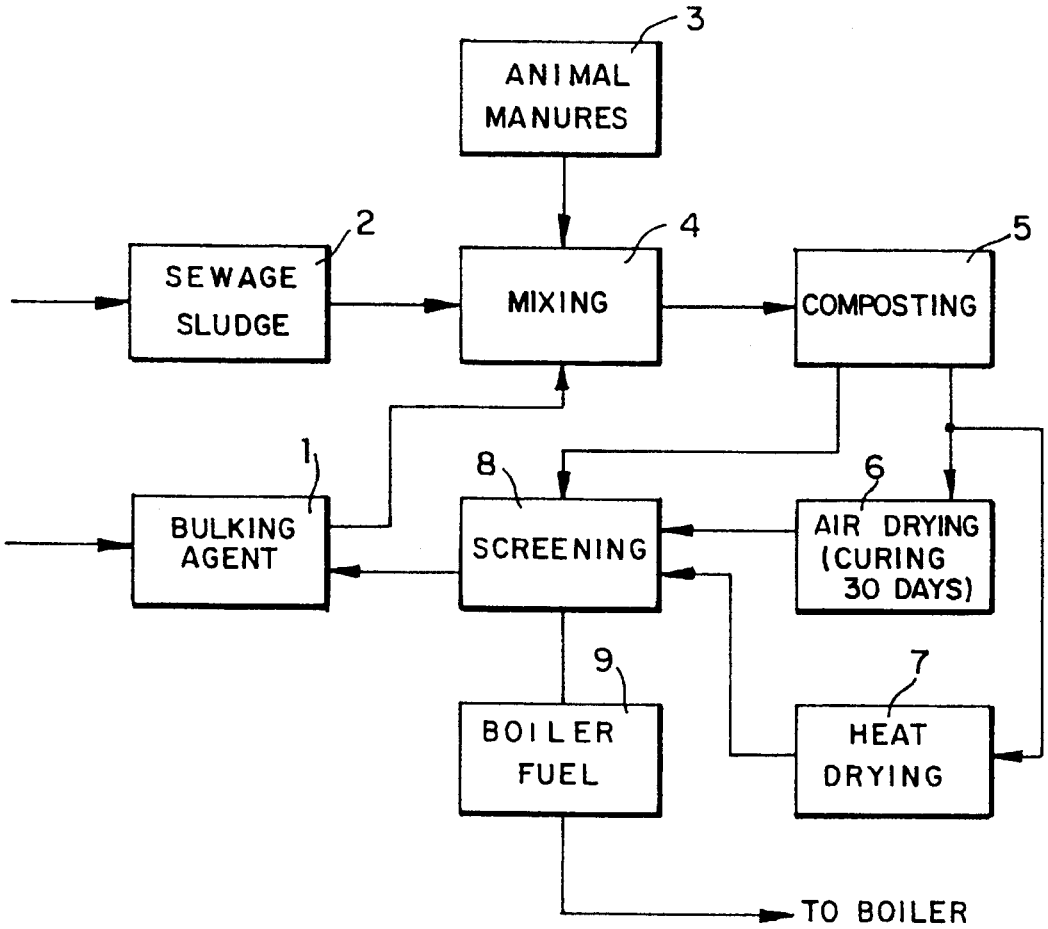
FIG. 1 is a schematic view of the composting method of the present invention.

The method of the present invention uses biological sludge as a starting material to produce a combustible fuel product. Biological sludges are those sludges produced by aerobic or anaerobic conversion of carbonaceous, proteinaceous and fatty materials and/or carbohydrates by microorganisms such as bacteria. The biological sludges employed can include sewage sludge, i.e., the output material from municipal wastewater treatment plants or sludge originating from food processing wastewater treatment. The biological sludge is dewatered to about 10 percent to about 20 percent total solids prior to its use in the method of the invention. Additionally, the biological sludge used in the method of the invention can be mixed with animal manures such as, e.g., those from chickens, turkeys, cows, horses, pigs and sheep.

The method of the invention can best be described by reference to FIG. 1. A removable bulking agent 1 is first mixed with the biological sludge 2. The bulking agent can be any water absorbing material that can be removed from the biological sludge after treatment by the method of the invention. Suitable bulking agents include wood chips, peanut hulls, ground corn cobs, pieces of wooden pallets or skids, or yard waste, for example. Typical yard wastes include tree trimmings, grass clippings, leaves, garden waste, saw dust, biodegradable paper leaf bags, and the like.

Preferably, the biological sludge or sludge/manure is mixed with the bulking agent at a ratio of about 1 part sludge to about 2 parts bulking agent. Mixing can be effected by any suitable mechanical mixer 4 such as a continuous screw extruder. One or more animal manures 3 can be mixed with the sludge and bulking agent.

The biological sludge/bulking agent mixture is then aerobically composted 5 under conditions effective to attain a temperature of about 170° F. to about 175° F. Preferably, the temperature is attained over a period of about 14 days and maintained for an additional seven days.

The aerobic composting step can be conducted in any suitable enclosure. Preferably, a composting pad is employed having dimensions of about 10 feet in width, about 6 to about 8 feet wide, about 6 feet to about 8 feet high and about 60 feet long, for instance. The conditions effective to attain the desired temperature range include controlling the input of air to the mixture. Most preferably, the composting pad contains a network of perforated pipes through which air can be forced with a blower.

In a particularly preferred embodiment, a sacrificial layer of wood chips or other bulking agent is layered over and around the pipe network and the sludge/bulking agent mixture is placed on top of the sacrificial layer. Another sacrificial layer of wood chips or other bulking agent is placed on top of the sludge/bulking agent mixture. The sacrificial layers provide positive air flow through the mixture, which otherwise tends to be reduced as the mixture settles. The sacrificial layer also helps to control the moisture level of the mixture, to prevent premature air drying, and it acts like a filter for airborne particles, as well as providing an odor control function in the composting process.

Thermocouples are imbedded in the sludge/bulking agent mixture to indicate the temperature of the mass. Air flow through the pipe network is regulated to raise the temperature to about 170° F. to about 175° F. over a period of about 14 days and then maintain the temperature of the mass in that temperature range for about seven days. These conditions are effective to substantially reduce the level of pathogenic microorganisms originally present in the biological sludge or sludge/manure mixture to produce a treated sludge mixture which is a combustible fuel product. Pathogenic microorganisms can include bacteria, viruses and parasites. A substantial reduction of pathogenic microorganisms is reduction to a level not greater than minimum governmental standards such as EPA Process to Significantly Reduce Pathogens (PSRP) and Process to Further Reduce Pathogens (PFRP) standards.

After the aerobic composting step is complete, the bulking agent can be separated from the combustible fuel product. Separation can be achieved by screening 8. The separated bulking agent can be recycled by adding it to the untreated biological sludge feed.

The combustible fuel produced by the method of the invention as described above has a moisture content of up to about 45 percent and a heating value of about 3,800 Btu/lb. The fuel product is sulfur free, i.e., no detectable levels of sulfur are present in the fuel product and accordingly, it will not produce sulfur dioxide when combusted. The fuel 9 is pathogen free and can be used directly as a feedstock in a conventional fluid-bed boiler or a circulating fluid-bed boiler.

A heating value of about 7,000 Btu/lb can be achieved by further drying of the fuel product to a moisture content of about 12 percent after the removal of the bulking agent. Further drying can be achieved by air drying 6 for about 30 days or more rapid heat drying 7, such as can be achieved with a steam tube dryer. The heating value obtained from further drying is equivalent to that of anthracite coal mining culm, a fuel currently used in fluid bed boiler systems. Additionally, fuel product containing 12 percent moisture can be pelletized or briquetted after mixing with a suitable binder and then used as a feedstock for grate-type boilers.

In an alternative embodiment of the method of the invention, shredded rubber is admixed with the separated fuel product to provide a product having a heating value of about 10,300 Btu/lb. The source of the shredded rubber can be automobile or truck tires. Preferably, the amount of shredded rubber admixed will be an amount that will not result in regulatory limitations on sulfur emissions being exceeded.

The invention will now be described with reference to the following, specific, non-limiting example.

EXAMPLE

Approximately three pounds of municipal sewage sludge obtained from the Scranton, Pennsylvania sewage treatment plant were treated per the method of the invention. The specific treatment conditions were as follows:

A sacrificial layer of wood chips about 12 in. deep was placed on a concrete composting pad in the laboratory covering an array of perforated pipes that was connected to an air blower. The sludge was thoroughly mixed with 6 lbs. of wood chips as a bulking agent. An upper layer of wood chips about 6 in. deep was placed on top of the mixture of sludge and bulking agent. The sludge mixture was allowed to compost for a period of about 7 days, during which the temperature of the mixture reached about 170° F. The temperature was maintained for about 21 days at a temperature range of about 170° F. to about 175° F. by blowing air (at a volume of about 600 cubic ft. per min.) through the mixture and sacrificial layers when necessary to lower the temperature to the target range. Thereafter, the mixture was screened to remove the bulking agent to produce a combustible fuel product. A portion of the product was air dried in the laboratory for a few hours. Another portion of the product was heat dried in an oven at an elevated temperature for a few hours.

Proximate analysis of the resulting fuel products per ASTM D3172 indicated the following:

| | No Drying | Air Dry | Heat Dry |
|---|---|---|---|
| Total Moisture (%) | 25.41 | 2.71 | 0.00 |
| Volatile Matter (%) | 33.94 | 44.27 | 45.50 |
| Fixed Carbon (%) | 8.40 | 10.96 | 11.27 |
| Ash (%) | 32.25 | 42.06 | 43.23 |
| Sulfur | 0.00 | 0.00 | 0.00 |
| Total | 100.00 | 100.00 | 100.00 |
| Btu/lb | 3,799 | 4,965 | 5,093 |

The analysis indicates that a fuel product with a moisture content of 25.41 percent and a heating value of about 3,800 Btu/lb was obtained by the method of the present invention. Additional drying resulted in fuel products having heating values of 4,965 and 5,093 Btu/lb. Sulfur was not detectable.

The present invention may be embodied in other specific forms without departing from the spirit or essential attributes thereof and, accordingly, reference should be made to the appended claims, rather than to the foregoing specification, as indicating the scope of the invention.

I claim:

1. A method for producing a combustible fuel product from biological sludge comprising:

a) mixing a removable bulking agent with the sludge;

b) aerobically composting the mixture of step a) under conditions effective to attain a temperature to about 170° F. to about 175° F.;

c) maintaining the temperature of the mixture at about 170° F. to about 175° F. for a time period sufficient to substantially reduce pathogenic microorganisms and produce a composted sludge mixture having a moisture content of up to about 45 percent; and d) separating the bulking agent from the composted sludge mixture to produce a treated sludge fuel product, wherein the fuel product has a heating value of about 3,800 Btu/lb to about 10,300 Btu/lb.

2. The method of claim 1 wherein the fuel product has a heating value of about 3,800 Btu/lb.

3. The method of claim 1 wherein the fuel product is sulfur free.

4. The method of claim 1 wherein the removable bulking agent is wood chips, peanut hulls or ground corn cobs.

5. The method of claim 1 wherein the removable bulking agent is yard waste.

6. The method of claim 1 wherein the ratio of the sludge to the removable bulking agent is about 1 to about 2.

7. The method of claim 1 wherein the biological sludge is sewage sludge or food waste sludge or mixtures thereof.

8. The method of claim 7 wherein the biological sludge is mixed with at least one animal manure.

9. The method of claim 1 further comprising an intermediate step:

c)1) drying the treated sludge to reduce the moisture content to about 12 percent, wherein the fuel product has a heating value of about 7,000 Btu/lb.

10. The method of claim 9 further comprising a step:

e) pelletizing the dried, treated waste.

11. The method of claim 9 further comprising a step:

e) briquetting the dried, treated waste.

12. The method of claim 1 wherein the temperature is attained over a period of about 14 days.

13. The method of claim 1 wherein the temperature is held for a period of about seven days.

14. The method of claim 1 further comprising a step:

e) admixing shredded rubber with the separated treated wastes, wherein the fuel product has a heating value of about 10,300 Btu/lb.

15. A combustible fuel product prepared from animal wastes by a method comprising the steps of:

a) mixing a removable bulking agent with the animal waste;

b) aerobically composting the mixture of step a) under conditions effective to attain a temperature to about 170° F. to about 175° F.;

c) maintaining the temperature of the mixture at about 170° F. to about 175° F. for a time period sufficient to substantially reduce pathogenic microorganisms and produce a composted waste mixture having a moisture content of up to about 45 percent; and d) separating the bulking agent from the composted waste mixture to produce a treated animal waste fuel product, wherein the fuel product has a heating value of about 3,800 Btu/lb to about 10,300 Btu/lb.

* * * * *